US008485101B2

(12) United States Patent
Frank

(10) Patent No.: US 8,485,101 B2
(45) Date of Patent: Jul. 16, 2013

(54) REUSABLE GRENADE

(76) Inventor: Scott Frank, Provo, UT (US)

( * ) Notice: Subject to any disclaimer, the term of this patent is extended or adjusted under 35 U.S.C. 154(b) by 0 days.

(21) Appl. No.: 13/155,635

(22) Filed: Jun. 8, 2011

(65) Prior Publication Data

US 2011/0306446 A1 Dec. 15, 2011

Related U.S. Application Data

(60) Provisional application No. 61/352,864, filed on Jun. 9, 2010.

(51) Int. Cl.
*F42B 8/26* (2006.01)

(52) U.S. Cl.
USPC ..... 102/498

(58) Field of Classification Search
USPC ..... 102/498, 482, 502, 513; 124/73, 124/70, 71, 72, 75
See application file for complete search history.

(56) References Cited

U.S. PATENT DOCUMENTS

| | | | | |
|---|---|---|---|---|
| 4,078,496 | A * | 3/1978 | Kruger et al. | 102/487 |
| 5,018,449 | A * | 5/1991 | Eidson, II | 102/498 |
| 5,590,886 | A | 1/1997 | Lush | |
| 5,996,503 | A * | 12/1999 | Woodall et al. | 102/498 |
| 6,349,650 | B1 * | 2/2002 | Brunn et al. | 102/368 |
| 6,453,819 | B1 | 9/2002 | Coates | |
| 6,871,594 | B1 | 3/2005 | Estrella | |
| 7,338,343 | B2 * | 3/2008 | Siu et al. | 446/473 |

* cited by examiner

*Primary Examiner* — Stephen M Johnson
*Assistant Examiner* — John D Cooper
(74) *Attorney, Agent, or Firm* — Bateman IP

(57) ABSTRACT

A reusable, pneumatic paint grenade that includes a dashpot timing mechanism for sudden release of compressed air that ruptures a frangible housing to disperse a dyed liquid or airsoft pellets after the paint grenade is thrown. The dashpot further comprises a plunger located in a cylindrical body. A lever in contact with the plunger of the dashpot forces the plunger downward to puncture a cartridge of compressed air with a sharp structure disposed between the plunger and the cartridge. The compressed air is prevented from escaping while the sharp structure remains in the cartridge. Once the lever is released, the plunger is forced into substantially its original position by a biasing mechanism and the force exerted by the air pressure within the cartridge. The cylindrical body can be filled with a viscous liquid to further slow movement of the plunger.

18 Claims, 9 Drawing Sheets

REUSABLE GRENADE

RELATED APPLICATIONS

The present application claims the benefit of U.S. Provisional Patent Application No. 61/352,864, filed Jun. 9, 2010, which is incorporated herein by reference.

BACKGROUND OF THE INVENTION

1. The Field of the Invention

The present invention relates to a reusable grenade. More specifically, the present invention relates to a frangible, pneumatic grenade that may be used to disperse a dyed liquid or airsoft pellets during the games of paintball or airsoft, or for professional training purposes.

2. State of the Art

Paintball has becoming increasingly popular in recent history. Paintball is a combat-type sport wherein teams of participants execute strategies and tactics, according to established rules, to eliminate opposing players by marking them with paint. The principal weapons are guns which use air or carbon dioxide to propel paintballs at opposing players. When a paintball hits an opposing player the outer shell is ruptured and a washable, pigmented liquid is dispersed. The player hit by the paintball is considered a casualty and is unable to further assist his or her team in the game.

Similar to paintball is the game of airsoft. However, in airsoft plastic, rubber, or foam pellets are fired at opposing players, rather than paint dispersing ammunition. Firearms used for airsoft shoot standard 6 mm or 8 mm pellets and typically have muzzle velocities of less than 500 feet per second. Anti-personnel weaponry, such as grenades, grenade launchers, and mines, are also often used during play. Furthermore, given airsoft's popularity for military simulations and historical reenactments, replicas of authentic firearms and anti-personnel weaponry are often desired.

Additionally, it is common for military and law enforcement personnel to use special training weapons that provide a mechanism for objectively scoring shooting and other combat skills. Again, paint dispersing and airsoft weapons have been employed for this purpose. It is particularly important in the training of military personnel to be able to simulate the use of hand grenades and their explosive fragmentation characteristics. To do this, it is necessary to have practice hand grenades for use in war games.

Reusable paint grenades have been designed to more realistically simulate the use and effect of actual military hand grenades. However, current models often fail to detonate and/or the timing mechanisms for delaying dispersion of the paint are unpredictable. For example the grenade described in U.S. Pat. No. 6,871,594 uses a pair of reactive chemicals that, when combined, produce sufficient gas pressure to rupture a frangible barrier inside the grenade to disperse the paint contained therein. The rate of the chemical reaction relied on to produce the gas propellant, however, is effected by a number of variables that can lead to unpredictable timing of the paint being dispersed, such as temperature and rate of mixture of the pair of chemicals.

Other prior paint grenades have similar and/or different disadvantages. For example, paint grenades described in U.S. Pat. Nos. 4,944,521 and 5,996,503 require reloading individual paint balls in the devices prior to reuse. Reloading individual paintballs is time consuming and not desirable in a game situation when the grenade needs to be available for rapid reuse.

Although reusable paint grenades are currently available, there is a need for an improved paint grenade and method of use. The present invention overcomes the disadvantages associated with current paint grenades described above. The timing mechanism of the paint grenade of the current invention is more reliable and predictable. Additionally, the paint grenade of the current invention is designed for rapid reuse.

SUMMARY OF THE INVENTION

It is an object of the present invention to provide an improved paint grenade.

According to one aspect of the present invention, the paint grenade may be reusable.

According to another aspect of the present invention, the paint grenade may simulate the fragmentation characteristics of an exploding hand grenade.

According to another aspect of the present invention, the paint grenade may include a reusable actuator and a frangible housing with a reservoir for receiving a dyed liquid or airsoft pellets.

According to still another aspect of the present invention, the paint grenade may use a cartridge of carbon dioxide, or other compressed air, as a propellant for dispersing paint or airsoft ammunition.

According to still another aspect of the present invention, the actuator of the paint grenade may include a lever (colloquially known as the spoon) with an elbow in contact with a plunger. At an opposite end of the plunger may be a sharp structure which punctures the cartridge of compressed air when the plunger is depressed. The sharp structure may prevent the compressed air from escaping the cartridge until the plunger returns to substantially its original position after the lever is released.

According to still another aspect of the present invention, the paint grenade may include a delay mechanism, such as a dashpot, to delay the release of compressed air from a cartridge, thereby delaying dispersion of paint, or the airsoft pellets, once the paint grenade is thrown. The dashpot may include a plunger in a cylindrical body surrounded by a viscous fluid.

In accordance with one particular aspect of the present invention, the plunger of the delay mechanism may be depressed by the lever of the paint grenade, which forces the sharp structure to puncture a cartridge of compressed air. Upon release of the lever, a biasing element and air pressure within the cartridge of compressed air may force the plunger to return to substantially the same position it was in prior to being depressed by the lever. Return of the plunger to this original position may be delayed further by including a viscous fluid, such as hydraulic fluid, in the cylindrical body containing the plunger. Paint or the airsoft pellets are dispersed once the plunger reaches its original position and the sharp structure no longer prevents the release of compressed air.

According to yet another aspect of the present invention, the paint grenade may have multiple safety mechanisms to prevent actuation of the paint grenade prior to its desired use.

According to still another aspect of the present invention, the paint grenade may be used during the games of paintball, airsoft, and/or during training of military or law enforcement personnel.

In accordance with another aspect of the present invention, the paint grenade may be quick and easy to reload for reuse.

These and other aspects of the present invention are realized in an improved paint grenade as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
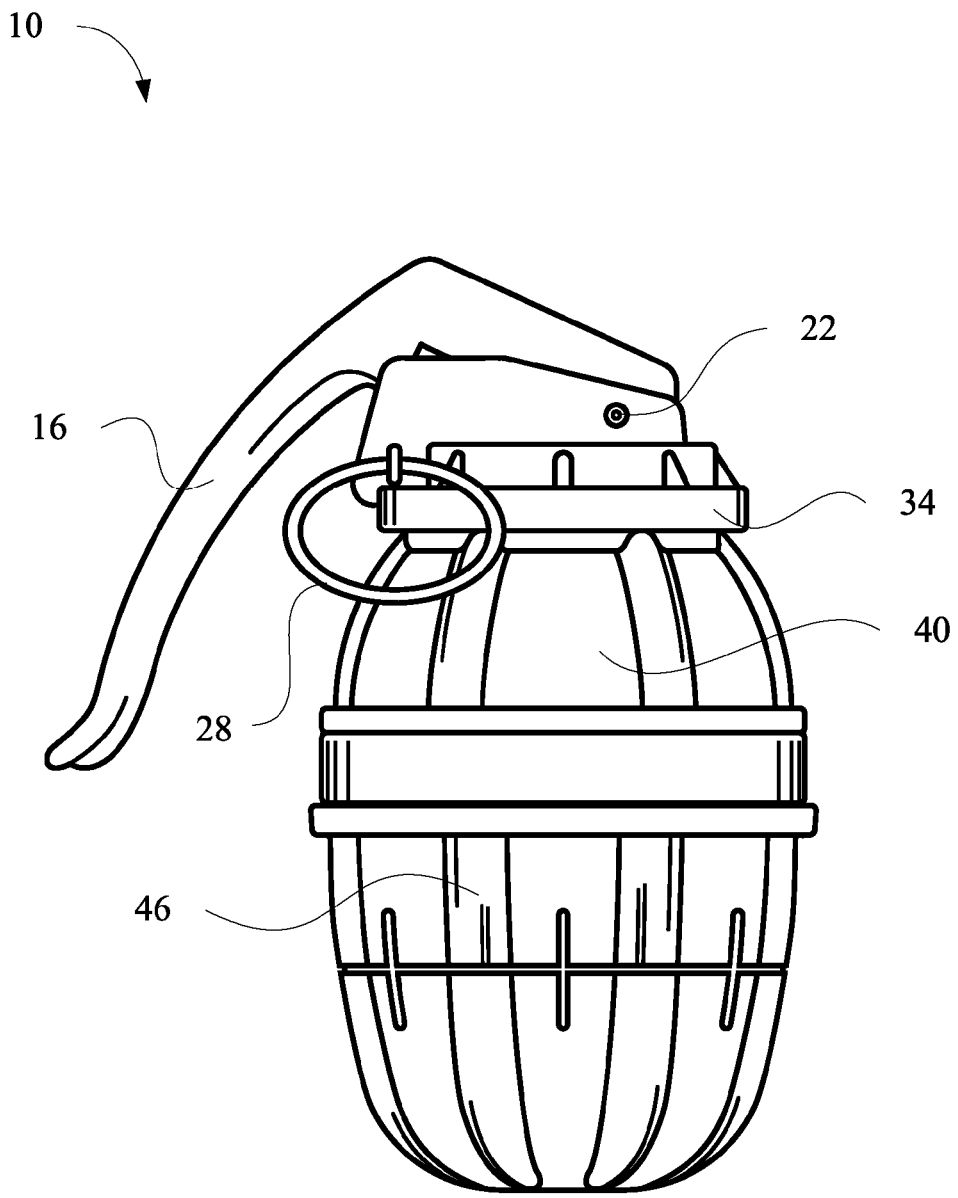
FIG. 1 shows a perspective view of a paint grenade according to the principles of the present invention.

Turning now to FIG. 1, a perspective view of a paint grenade, generally indicated at 10, made in accordance with the principles of the present invention is shown. The paint grenade may use a cartridge of carbon dioxide, or other compressed air, as a propellant for dispersing paint or airsoft pellets. The paint grenade 10 may include an actuator (more clearly shown in FIG. 2) having a reusable upper member 40. The actuator may include a lever 16 with an elbow in contact with a plunger (not shown). Lever 16 may be pivotally attached at 22 to cap 34. Cap 34 may be removably attached to upper member 40, but it will be appreciated that cap 34 may be preformed as part of upper member 40.

Also shown is a lower member 46. Lower member 46 may be a frangible housing with a reservoir for receiving a dyed liquid or airsoft pellets. Lower member 46 may be removably attached to upper member 40, for example lower member 46 may threadably attached to upper section 40. Sudden release of compressed air within lower member 46 causes the housing to explode, thereby dispersing the dyed liquid or airsoft pellets. The contents of the reservoir may be dispersed in an arc of about 120° to about 140°, in approximately a 15 to 20 foot radius from the paint grenade.

The paint grenade may include safety mechanisms, such as lever 16 and pin 28 shown in FIG. 1. When lever 16 is depressed the elbow section on lever 16 may force a plunger within upper member 40 downward. At an opposite end of the plunger may be a sharp structure which punctures a cartridge of compressed air when the plunger is depressed. Pin 18 may be inserted through an opening in cap 34 and an opening in lever 16 when the two openings are substantially in the same plane to lock the lever in a depressed position. When the lever is in a depressed position the sharp structure may prevent the compressed air from escaping the cartridge until the plunger returns to substantially its original position after the lever is released. In order for the plunger to return to substantially its original position, the pin must be removed and lever 16 released.

Figure 2:
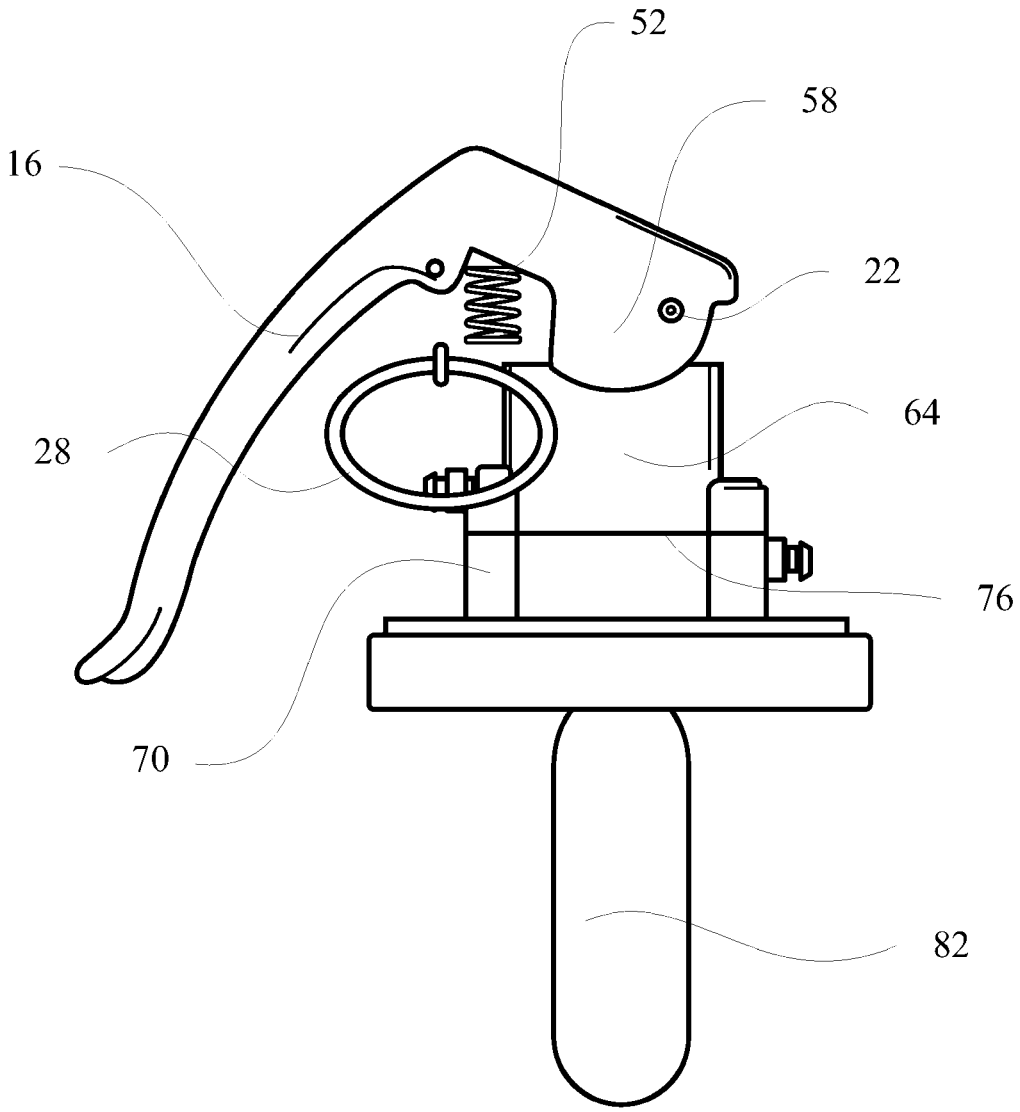
FIG. 2 shows a perspective view of an actuator of the paint grenade according to principles of the present invention.

Now turning to FIG. 2, a perspective view of an actuator of the paint grenade 10 is shown. Elbow section 58 can be seen in contact with a plunger within upper section 64 of the delay mechanism. A cartridge of carbon dioxide 82, or other compressed air may be removably attached to the bottom section 70 of the delay mechanism. When lever 16 is depressed elbow 58 forces the plunger downward. The opposite end of the plunger is in communication with cartridge 82 via a structure configured to puncture cartridge 82 when it is forced downward. According to one aspect of the invention, attached the opposite end of the plunger is a sharp structure that punctures the cartridge 82. When the grenade is ready to be thrown at a target, lever 16 is released and a biasing mechanism 52, such as a spring, band, etc. and air pressure from the cartridge 82 force the lever 16 upward allowing the plunger within the delay mechanism to return to substantially its original position. When the plunger reaches substantially its original position the structure, configured to puncture cartridge 82, exits cartridge 82 and compressed air is suddenly released therefrom.

Figure 3:
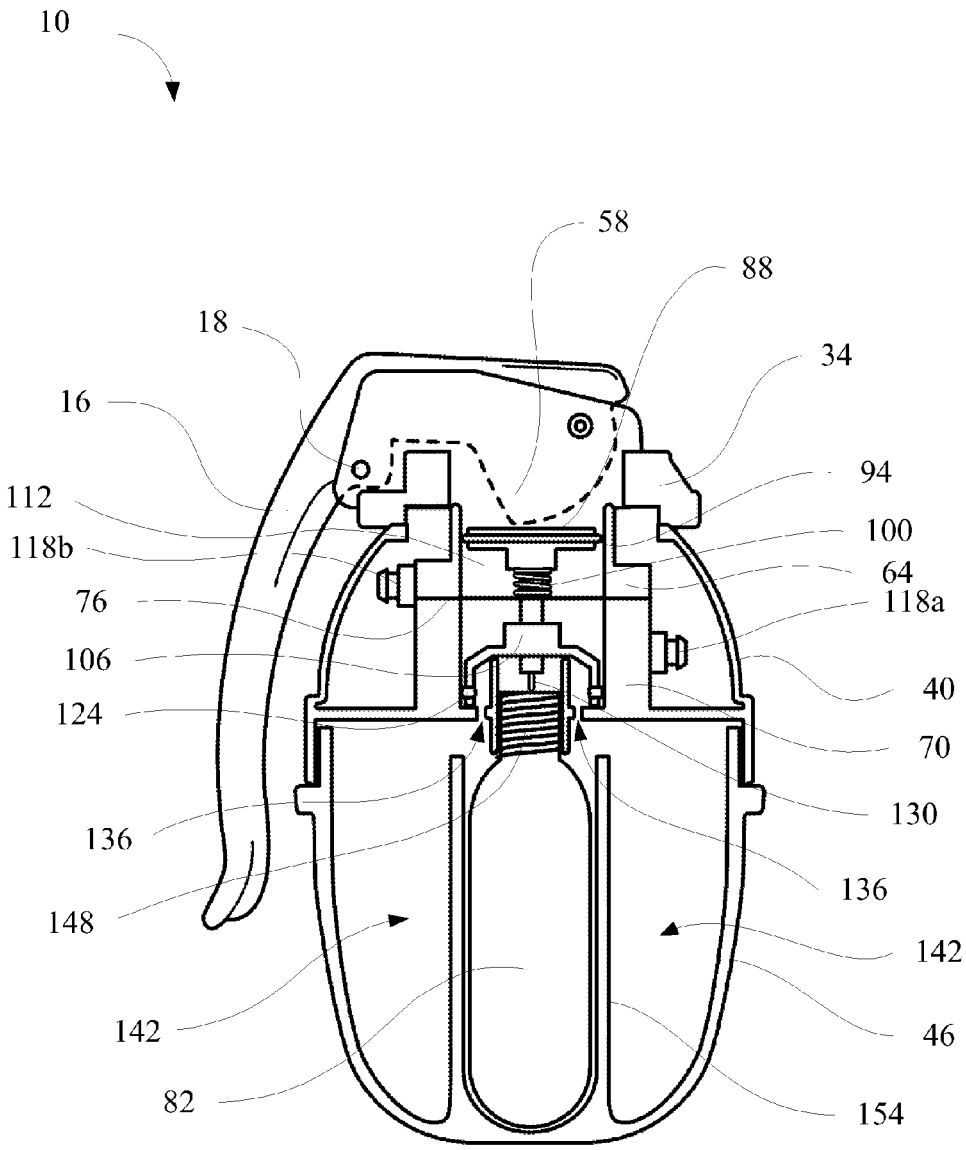
FIG. 3 shows a cross-sectional view of a paint grenade of the present invention with the lever depressing the plunger to puncture a cartridge of compressed air.

FIG. 3 shows a cross-sectional view of a paint grenade 10 of the present invention with the lever 16 depressing the plunger 88 and a sharp structure 130 puncturing a cartridge of compressed air 82. Elbow 58 contacts plunger 88 and forces it downward. At an opposite end of plunger 88 is a sharp structure 130, such as a needle, pin, nail, etc., that punctures the top of cartridge 82. Cartridge 82 may be threadably connected to the lower section 40 of the delay mechanism. The carbon dioxide, or other compressed air, inside cartridge 82 is mechanically prevented from escaping while the sharp structure 130 remains inside cartridge 82. Additionally, a pin can be inserted into opening 18 to hold lever 16 in a depressed position until use of the paint grenade 10 is desired.

Also, the reservoir 142 of lower member 46 according to principles of the present invention is more clearly seen. Reservoir 142 is filled with a dyed liquid or airsoft pellets and connected to upper section 40 of paint grenade 10 prior to use. Lower member 46 can be threadably connected to upper section 40, but it should be appreciated that lower member 46 can be connected to upper section 40 using a variety of other methods. Furthermore, lower member 46 may include a compartment 154 for holding cartridge 82.

Figure 4:
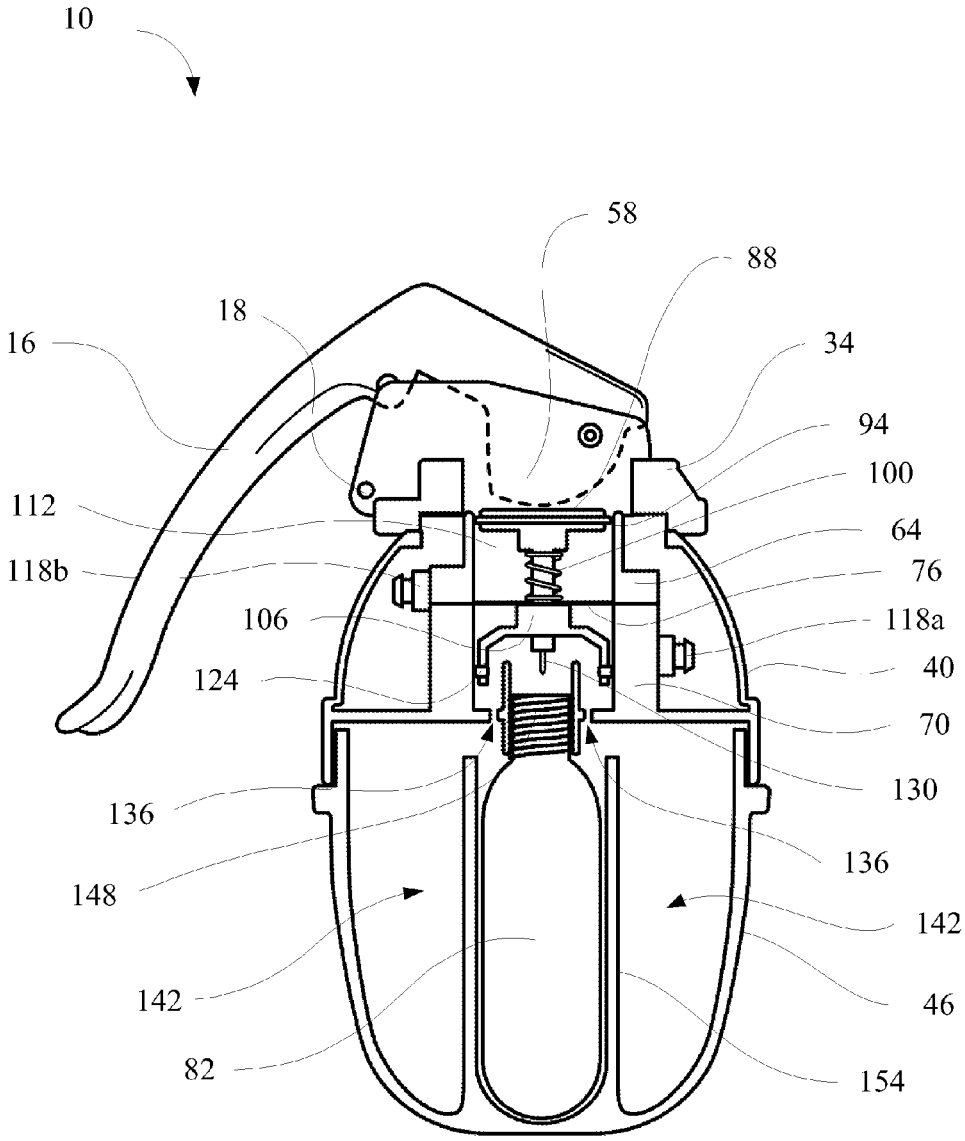
FIG. 4 shows a cross-sectional view of a paint grenade of the present invention with the lever released and the plunger in a position to allow for release of compressed air from the cartridge.

Now turning to FIG. 4, a cross-sectional view of a paint grenade 10 of the present invention with the lever 16 released and the plunger 88 in a position to allow for release of the compressed air in cartridge 82. Paint grenade 10 is configured so that, once a user lets go of lever 16, there is delayed, sudden release of compressed air from cartridge 82. For example, after lever 16 is released, compressed air in cartridge 82 may be suddenly released about 3 seconds later. Timing of detonation of paint grenade 10 can be modified, for example, by varying the length of the sharp structure 130, thus increasing the time it will take for sharp structure 130 to exit the top of cartridge 82.

The paint grenade 10 may also use a dashpot to delay the return of the plunger 88 to substantially its original position after the lever 16 is released. The dashpot housing may include an upper section 64 removably connected to a lower section 70. The dashpot housing has a cylindrical inner opening 112 containing plunger 88, and a barrier 76 between upper section 64 and lower section 70.

When lever 16 is released plunger 88 is forced to return to substantially its original position by a biasing mechanism 100, such as a spring, and the force exerted by the compressed air in cartridge 82. The rod of the plunger 88 may have multiple diameters, with the diameter of a portion of the rod 106 is large enough to contact barrier 76 when the lever is released, thus preventing plunger 88 from extending outside of upper section 64.

Movement of the plunger within the dashpot housing may be further slowed by including a viscous fluid, such as hydraulic fluid, within the cylindrical opening 112 inside the dashpot housing. To prevent the hydraulic fluid from escaping from cylindrical opening 112, the plunger may include sealing member, such as o-rings 94 and 124 to seal the cylindrical opening 112.

Once the sharp structure exits the cartridge 82, the compressed air is released and may be directed into the frangible housing 46 through venting holes 136. Sudden build up of pressure from the compressed air inside the frangible housing 46, causes the frangible housing to rupture and disperse the dyed liquid or airsoft pellets in reservoir 142 as described above.

Figure 5:
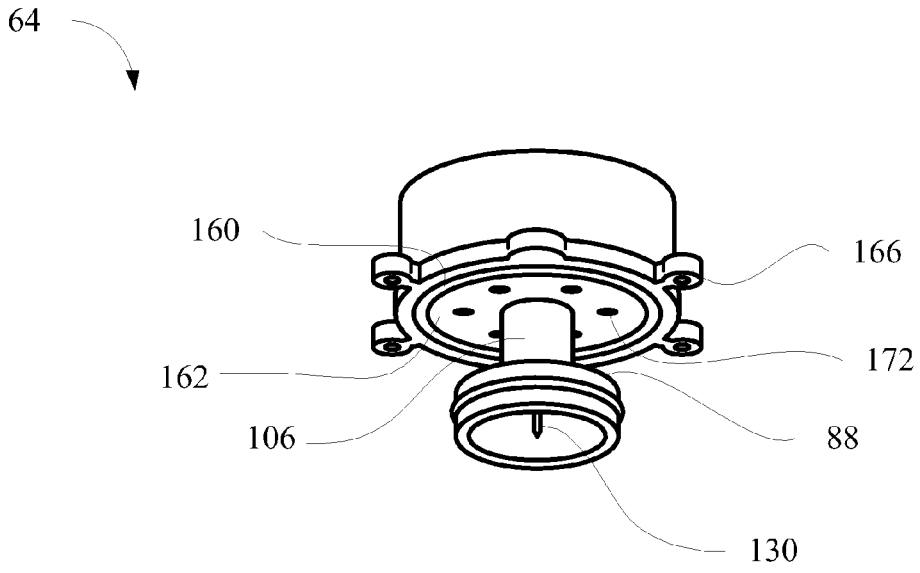
FIG. 5 shows a perspective view of an upper section of a delay mechanism according to principles of the present invention.
Figure 6:
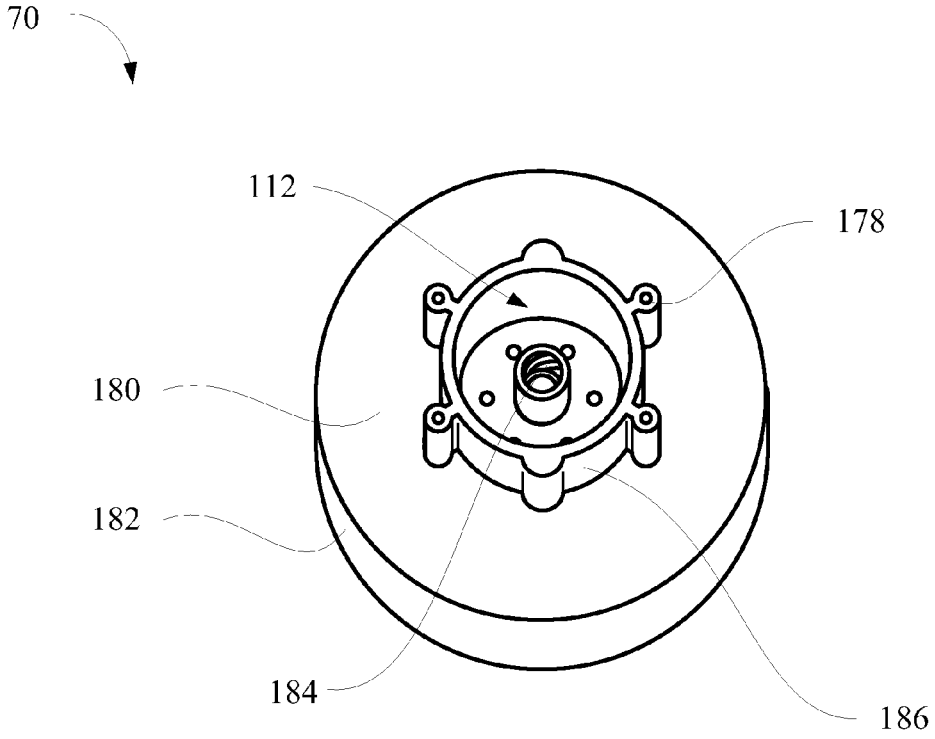
FIG. 6 shows a perspective view of a bottom section of a delay mechanism according to principles of the present invention.

Now turning to FIG. 5 and FIG. 6, a perspective view of a top section 64, and lower section 70, of a delay mechanism according to principles of the present invention. The cylindrical opening 112 of upper section 64 may be enclosed by a lower side 162. Lower side 162 creates a barrier inside the dashpot housing between upper section 64 when it is connected to lower section 70. Openings 172 in base 162 allows fluid to pass therethrough when lever 16 is released and plunger 88 is forced upward.

As can be seen, upper section 64 and lower section 70 may be formed with a plurality of attachment members 166 and 178, respectively, for removably connecting upper section 64 to lower section 70. Upper section 64 can be connected to lower section 70 using bolts, screws, etc. However, it will be appreciated that upper section 64 may be connected to lower section 70 using alternate methods, or upper section 64 and lower section 70 could be preformed as a single structure.

Additionally, to ensure that the cylindrical opening 112 inside the dashpot housing is properly sealed, upper section 64 may be formed with a groove 160 for receiving a gasket, such as an o-ring. Inclusion of an o-ring in groove 160 helps prevent fluid from escaping from the cylindrical opening 112 when upper section 64 and lower section 70 are removably connected.

Figure 7:
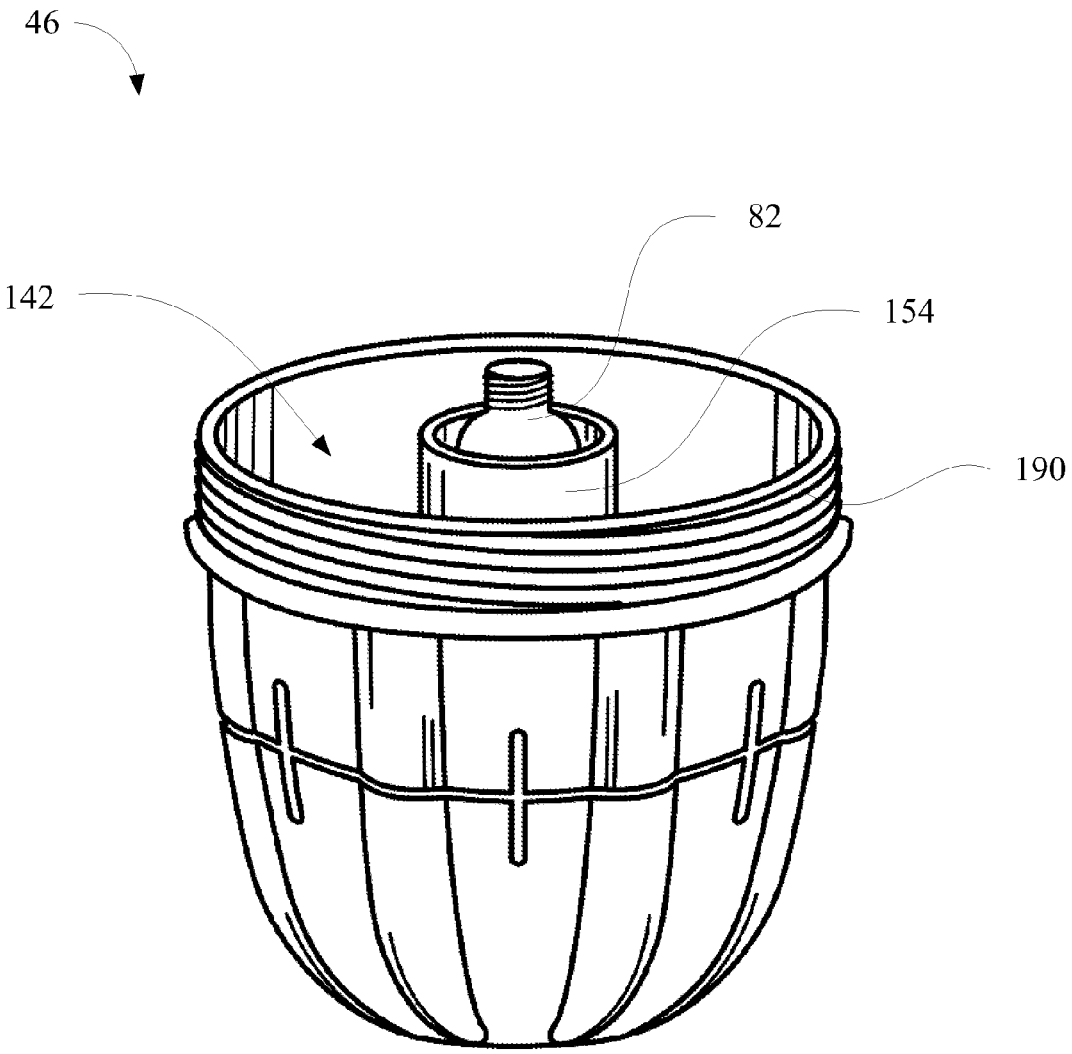
FIG. 7 shows a perspective view of a frangible housing that can hold a cartridge of compressed air and includes a reservoir for receiving a dyed liquid.

Lower section 70 may include a base 180 preformed with the bottom of the dashpot housing 186. Base 180 may include sidewall 182, with threads on the inner surface for receiving the lower member 46 (as shown in FIG. 7). Additionally, lower section 70 may include threads 184 for receiving a standard cartridge of carbon dioxide or other compressed air. It will be appreciated that lower section 70 may be attached to lower member 46 using alternative methods, such as being snap fitted or using clips.

Also shown in FIG. 6 is the cylindrical opening 112 of the dashpot housing of lower section 70. Vent holes 136 in the floor of the cylindrical opening 112 allow the compressed air to escape into the frangible housing 46 after lever 16 is released and the paint grenade 10 is thrown at a target, causing the lower member 46 to burst and the dyed liquid contained therein to be dispersed.

Now turning to FIG. 7, there is shown a perspective view of a lower member, generally indicated at 46, that can hold a cartridge 82 of compressed air and includes a reservoir 142 for receiving dyed liquid, airsoft pellets, or some other projectile. The lower member 46 may be a frangible housing and include threads 190 for threadably connecting the lower member 46 to lower section 70 (FIG. 6). The lower member 46 may also include a compartment 154 for holding a standard cartridge 82 of carbon dioxide, or other compressed air.

Figure 8:
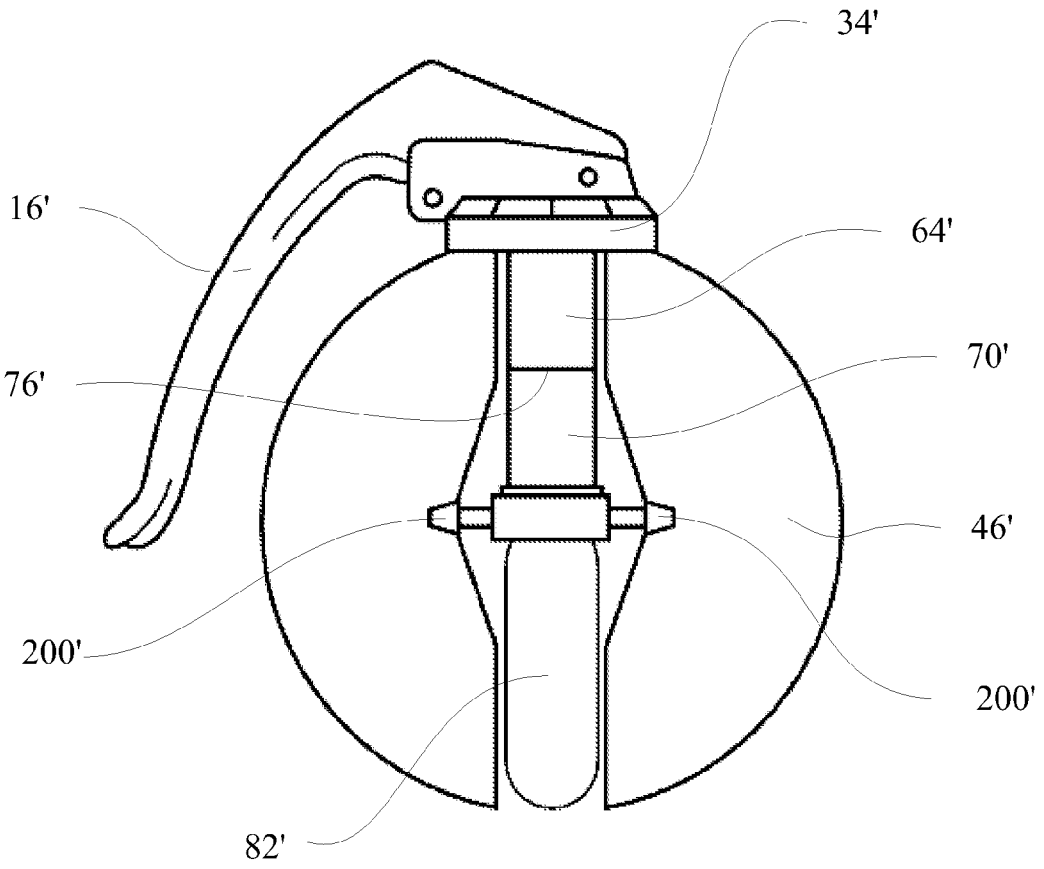
FIG. 8 shows a cross-sectional view of an alternate paint grenade according to principles of the present invention.

It will be appreciated that the grenade of the present invention can have various configurations. For example, FIG. 8 shows a cross-sectional view of one such alternate configuration of a grenade, generally indicated at 10'. The reusable actuator is generally located in the interior of paint grenade 10'. Rather than being located beneath the actuator, lower members 46' surrounds the actuator so that the actuator is located inside the lower members 46'.

Similar to the above description, paint grenade 10' may include a delay mechanism, such as a dashpot, formed by upper section 64' and lower section 70'. When lever 16' is depressed it forces a plunger contained within the cylindrical opening inside the dashpot housing downward, thereby puncturing the cartridge 82 with a structure in communication with the opposite end of the plunger and cartridge 82.

When lever 16' is released, the plunger is forced into substantially its original position by a biasing mechanism and the force exerted by the pressure from the compressed air inside cartridge 82. When the structure exits cartridge 82, the compressed air escapes and is directed into lower members 46' via vent holes 200', thus causing the lower members 46' to rupture and paint or airsoft pellets to be dispersed.

The configuration of paint grenade 10' may provide for a more predictable pattern of paint or airsoft pellet dispersion, as opposed to the configuration of paint grenade 10. After paint grenade 10 is thrown it may land on the ground in a variety of positions. When the lower member 46 of paint grenade 10 explodes, a majority of the paint or airsoft pellets will be directed in the direction lower member 46 happens to be pointing. However, because paint grenade 10' may include a plurality of individual lower members 46', each of which generally extend the length of paint grenade 10', the dyed liquid or airsoft pellets may be dispersed more uniformly as described in more detail below, thereby increasing the likelihood that the target will be marked by the dyed liquid or hit by airsoft pellets.

Figure 9:
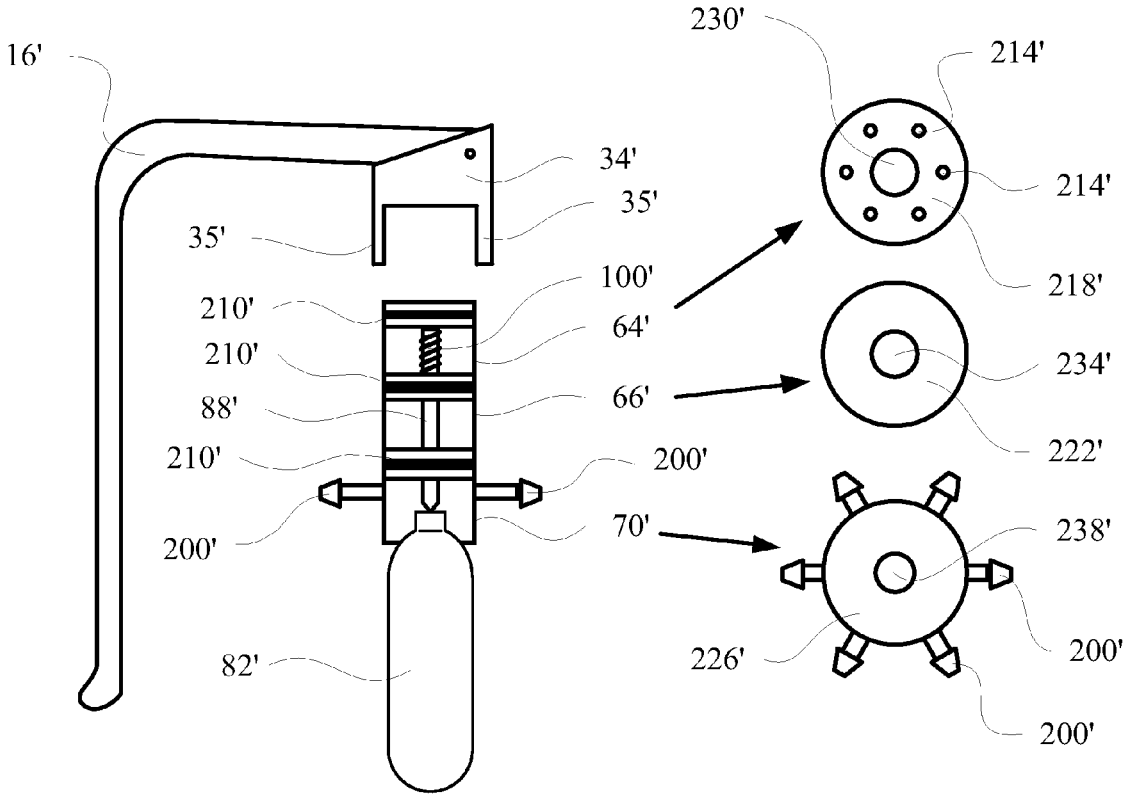
FIG. 9 shows an exploded view of an actuator of the paint grenade according to principles of the present invention.

FIG. 9 shows an exploded view of an actuator of the paint grenade according to one aspect of the present invention. The actuator may include a delay mechanism, such as a dashpot, having an upper section 64', a lower section 70', and a middle section 66'. Each of the sections 64', 66', and 70' may be cylindrical in shape and have threads for removably attaching the sections to each other and to cap 34'. Cap 34' may be configured to have sidewalls 35' that are substantially flush with upper section 64' when connected thereto.

Also shown in FIG. 9 are bottom views of upper section 64', lower section 70', and middle section 66'. Each of the sections may include a bottom wall 218', 222', 226', respectively, having an aperture 230', 234', 238' generally disposed in the center of bottom walls 218', 222', 226' to allow for passage of plunger 88' therethrough. Aperatures 230', 234', 238' may be fitted with a sealing member to prevent passage of fluid between the sections 64', 66', and 70'.

Upper section 64' and middle section 66' may contain a viscous fluid to slow the movement of plunger 88' once lever 16' is released. Bottom wall 218' of upper section 64' may include a plurality of holes 214' to allow the viscous fluid to pass between upper section 64' and middle section 66'.

Lower section 70' may include a plurality of passageways 200' from which compressed air from cartridge 82' is released after it has been punctured and lever 16' returns to substantially its original position. According to one aspect of the invention, lower section 70' may include six generally horizontal passageways 200'. Additionally, lower section 70' may be configured to receive cartridge 82' by, for example, by threadably attaching to cartridge 82'. At the distal ends of passageways 200' a housing having a reservoir for receiving projectile(s), such as a dyed liquid or airsoft pellets.

Figure 10:
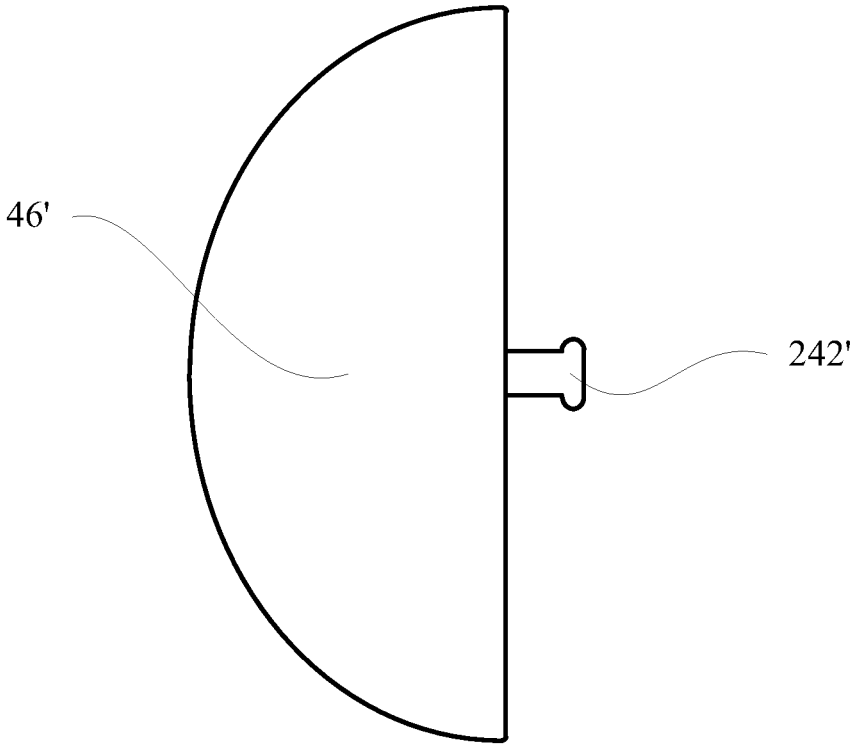
FIG. 10 shows a side view of a frangible housing that may be used with the actuator of FIG. 9.
Figure 11:
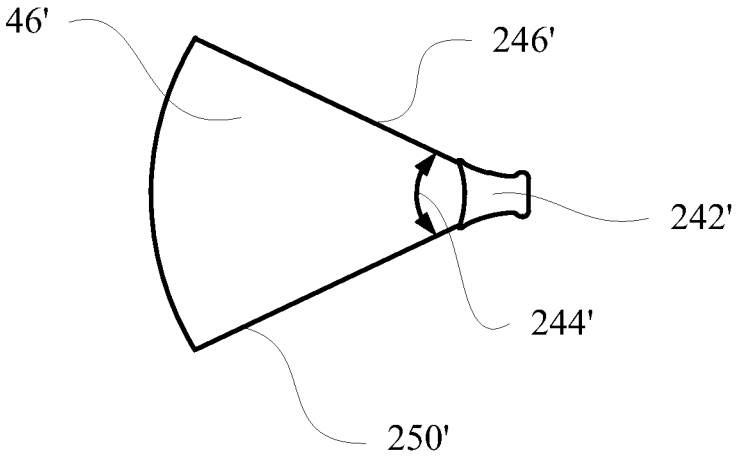
FIG. 11 shows a top view of the frangible housing of FIG. 10.

FIGS. 10 and 11, show a side and top view, respectively, of a housing 46' that may attach to passageways 200'. Housing 46' may attach to the distal end of passageways 200' via an attachment member 242'. A sufficient amount of compressed air is released from cartridge 82' (FIG. 9) and passes through passageways 200' into housing 46' to cause housing 46' to rupture and disperse a projectile contained within housing 46', such as dyed liquid or airsoft pellets. As is shown in FIG. 11, housing 46' may have side walls 246' and 250' which are spaced apart at an angle 244' so that when a plurality of housings 46' are attached to passageways 200' the sections 64', 66', and 70' (FIG. 9) are substantially enclosed by housings 46'. For example, if lower section 70' includes six passageways 200', then side walls 246' and 250' of housings 46' attached thereto should be spaced apart at an angle 244" of about 60° to substantially enclose sections 64', 66', and 70'.

As discussed above, by connecting multiple housings 46' to grenade 10' may ensure more uniform dispersal of a projectile, such as a dyed liquid or airsoft pellets, from grenade 10' because each individual housing will explode outwardly at an angle from the centrally located actuator of grenade 10'. Moreover, as housings 46' extend substantially the entire length of grenade 10', the coverage area of a dispersed projectile(s) from grenade 10' will likely be greater than the coverage area provided by grenade 10.

There is thus disclosed an improved grenade that can be used during the games of paintball or airsoft, or for training military and law enforcement personnel. It will be appreciated that numerous changes may be made to the present invention without departing from the scope of the claims.

What is claimed is:

1. A paint grenade comprising:

an upper member comprising a dashpot delay mechanism;

a housing operably connected to the upper member, the housing having a reservoir for holding a liquid or airsoft pellets therein;

a sufficiently sharp structure to puncture a cartridge of compressed air when the cartridge of compressed air is disposed in the housing;

wherein the dashpot delay mechanism is disposed in communication with the upper member and the housing;

wherein compressed air is introduced into the housing of the grenade to rupture the housing and disperse the liquid or non-metallic pellets in the reservoir in an arc of about 120 degrees; and wherein the upper member and the dashpot delay mechanism are reusable after the housing is ruptured.

2. The paint grenade of claim 1, wherein the dashpot delay mechanism is configured to releasably engage the cartridge of compressed air.

3. The paint grenade according to claim 1, wherein the dashpot delay mechanism is comprised of a cylindrical housing and a plunger.

4. The paint grenade according to claim 3, wherein the plunger of the delay mechanism further comprises a first end and a second end, and wherein the sharp structure is disposed adjacent the second end of the plunger.

5. The paint grenade according to claim 4, wherein the second end of the plunger prevents release of compressed air from a cartridge of compressed air prior to the sharp structure exiting the cartridge.

6. The paint grenade of claim 3, wherein the delay mechanism includes an upper section and a lower section, and wherein the upper section is removably connected to the lower section.

7. The paint grenade according to claim 3, wherein the delay mechanism includes a viscous liquid inside the cylindrical body.

8. The paint grenade according to claim 3, wherein the cylindrical body is comprised of an upper compartment, a middle compartment and a lower compartment, and wherein a viscous liquid is located within the upper compartment and lower compartment.

9. The paint grenade according to claim 1, wherein the housing is releasably attached to the dashpot delay mechanism.

10. The paint grenade according to claim 9, further comprising a plurality of housings which are releasably attached to the dashpot delay mechanism, wherein each housing of the plurality of housings have a reservoir for holding a liquid or non-metallic pellets therein.

11. The paint grenade according to claim 1, wherein the delay mechanism includes at least one safety mechanism.

12. A method of forming a paint grenade, the method comprising:

selecting an upper member;

releasably connecting a dashpot delay mechanism to the upper member;

operably connecting a housing to the upper member;

attaching a cartridge of compressed air to the dashpot delay mechanism and disposing a structure adjacent the cartridge of compressed air wherein the structure is sufficiently sharp to puncture the cartridge of compressed air;

wherein the dashpot delay mechanism is disposed in communication with the upper member and the housing;

wherein the upper member and the dashpot delay mechanism are configured for rapid reuse.

13. The method of claim 12, wherein the method comprises connecting the dashpot delay mechanism to the upper member, and wherein the dashpot delay mechanism includes a cylindrical body and a plunger.

14. The method of claim 13, wherein the method further comprises the step of surrounding the plunger with a viscous liquid.

15. The method of claim 13, further comprising the step of attaching a cartridge of compressed air to the dashpot delay mechanism and wherein the plunger of the delay mechanism has a first end and a second end wherein the second end of the plunger prevents release of compressed air from a cartridge of compressed air.

16. The of claim 13, wherein the cylindrical body is comprised of an upper compartment, a middle compartment and a lower compartment, and wherein a viscous liquid is located within the upper compartment and lower compartment.

17. The method of claim 12, wherein the method comprises threadably connecting the housing to the upper member.

18. The method of claim 12, wherein the compressed air from the cartridge is directed into the housing to rupture the housing and disperse a dyed liquid or non-metallic pellets.

* * * * *